United States Patent [19]

Weaver

[11] Patent Number: 4,512,149

[45] Date of Patent: Apr. 23, 1985

[54] OIL WELL PUMPING UNIT

[76] Inventor: Paul E. Weaver, P.O. Box 886, Stuttgart, Ark. 72180

[21] Appl. No.: 348,003

[22] Filed: Feb. 11, 1982

[51] Int. Cl.[3] ..... F01L 25/08; F01B 9/00

[52] U.S. Cl. ..... 60/371; 91/275; 91/304; 91/420; 92/137

[58] Field of Search ..... 92/137; 74/89.22, 89.21; 60/371; 91/275, 304, 420

[56] References Cited

U.S. PATENT DOCUMENTS

| | | | |
|---|---|---|---|
| 2,681,623 | 6/1954 | Kane | 92/137 |
| 2,683,424 | 7/1954 | Kane | 92/137 |
| 3,782,117 | 1/1974 | James | 92/137 |

*Primary Examiner*—Paul E. Maslousky
*Attorney, Agent, or Firm*—Harvey B. Jacobson

[57] ABSTRACT

A pumping unit for wells which is hydraulically powered and adapted to replace or used in lieu of conventional pump jacks. The hydraulic system utilized with the hydraulically operated pumping unit includes an accumulator system which stores energy produced by gravity induced downward movement of the pump rod and other pump components during the down stroke and automatically utilizes this stored energy to assist in lifting the pump components and the column of production fluid thereby increasing the efficiency of the pumping unit. The pumping unit utilizes a pair of hydraulically operated piston and cylinder assemblies having a lower end stationarily connected to a supporting structure and an upper end connected to a vertically guided slide assembly having a pair of grooved pulleys journaled thereon with flexible link chains entrained thereover with one end of the chains being anchored to the supporting structure and the other ends depending from the slide assembly and connected to the polish rod whereby the linear movement of the pistons in the piston and cylinder assemblies will be one-half of the linear movement of the polish rod, thereby providing a compact structure so that the vertical movement of the slide assembly can be more effectively guided and controlled. The entire pumping unit is mounted on a supporting skid or framework with all of the valves and high pressure connections being disposed interiorly of a reservoir except for the motor-pump unit and the cylinders and conduits connecting the upper and lower ends of the cylinders to the hydraulic system.

6 Claims, 5 Drawing Figures

FIG. 2
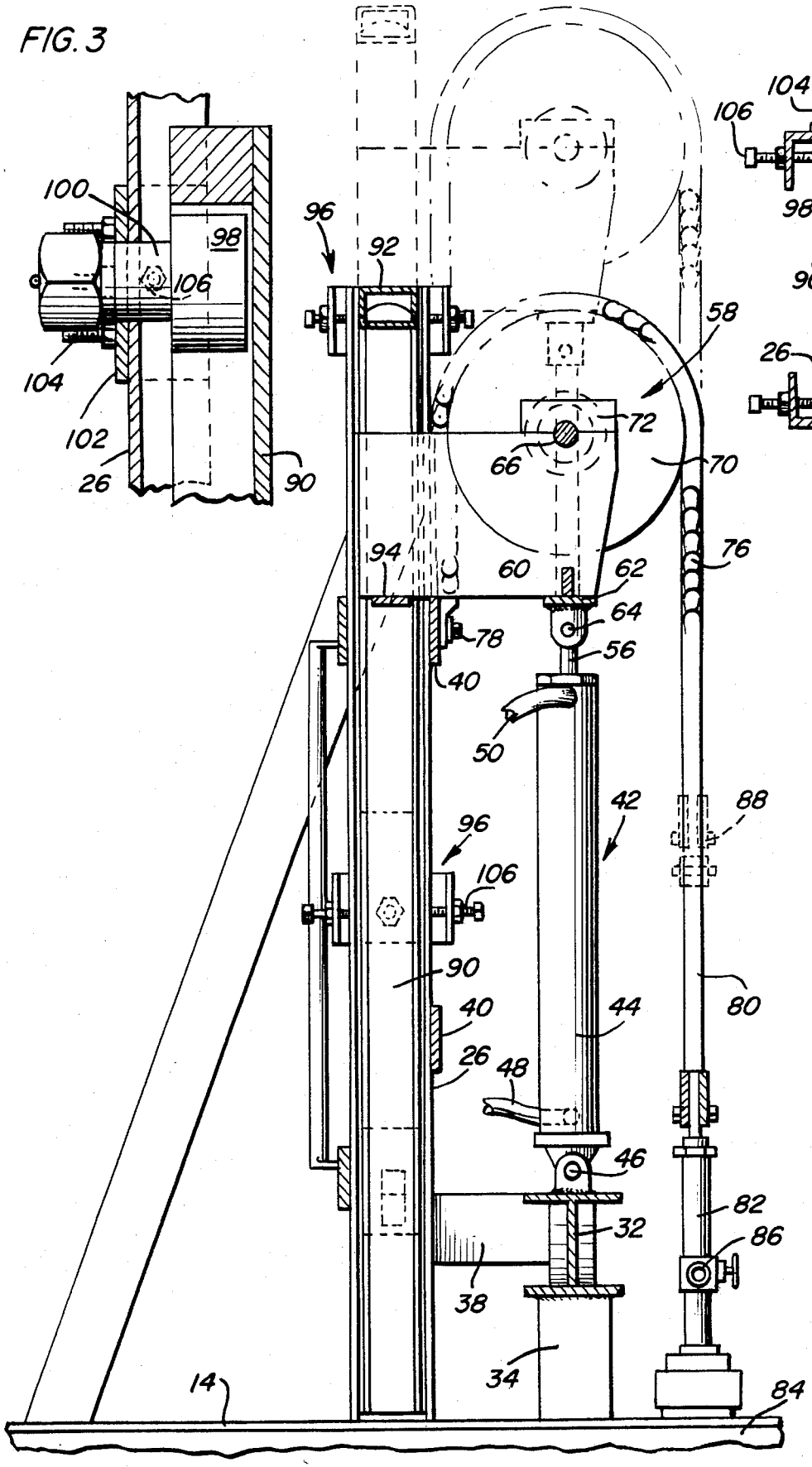
FIG. 3
FIG. 4
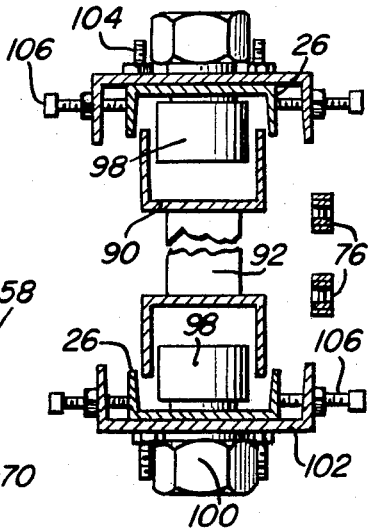

OIL WELL PUMPING UNIT

BACKGROUND OF THE INVENTION

1. Field of the Invention

The present invention generally relates to a well pumping unit and, more particularly, a hydraulically operated oil well pumping unit utilizing hydraulically powered piston and cylinder assemblies oriented vertically for reciprocating a slide assembly having flexible members entrained over rotatable wheels or pulleys mounted thereon with one end of the flexible members being anchored and the other end connected to the polish rod of the oil well pump assembly so that the polish rod and operating piston of the pump unit will move a linear distance twice the linear movement of the slide assembly with the hydraulic system operating the cylinders including an accumulator for storing energy produced by gravity induced downward movement of the pump rod and other reciprocating pump components by movement of hydraulic fluid from the lower ends of the cylinders into the accumulators with this stored energy being automatically used to assist in upward lift of the pump components when the polish rod and other components are being lifted thereby increasing the efficiency of the pumping unit.

2. Description of the Prior Art

Conventional oil well pumping units utilize pump jacks which include an elongated oscillating beam having a horsehead at one end connected with a cable system attached to the upper end of the polish rod and a massive, counterweighted drive system connected to the opposite end of the beam. Such devices are quite costly due to their extremely heavy weight and various structural components. When it is necessary to adjust the stroke or vary the frequency of the cycles of operation, it is necessary to completely shutdown the pumping unit for several hours, usually four to six hours. Additionally, the shipping cost is high due to the weight of such units and when maintenance is required, such as rebuilding the unit, the components are costly and considerable shutdown time is required. Efforts have been made to utilize fluid pressure operating units in which piston and cylinder assemblies have been connected to the oscillating beam as a replacement for the massive mechanical drive system, but as a general rule, such devices have not replaced the conventional pump jack. The following U.S. patents are exemplary of the prior art in this field of endeavor.

| | | | |
|---|---|---|---|
| U.S. Pat. Nos.: | 3,782,117 | U.S. Pat. Nos.: | 1,758,453 |
| | 4,191,010 | | 1,888,621 |
| | 3,072,219 | | 2,310,001 |
| | Re.25,432 | | 2,169,815 |
| | 3,977,680 | | 2,432,735 |
| | 1,379,378 | | 2,915,919 |
| | 4,037,662 | | 3,264,942 |
| | 3,739,853 | | 4,099,447 |
| | 2,949,960 | | 4,201,115. |

SUMMARY OF THE INVENTION

An object of the present invention is to provide a hydraulically operated well pumping unit utilizing hydraulically operated piston and cylinder assemblies for reciprocating the polish rod, sucker rod and pump components, with the hydraulic system connected to the piston and cylinder assemblies including accumulators for accumulating and storing energy in the form of hydraulic oil under pressure discharged from the lower ends of the cylinders due to the down stroke of the polish rod, sucker rod and pump components induced by gravity with the stored energy being automatically released back to the lower ends of the cylinders to assist in the upstroke of the pistons, thereby assisting in lifting the polish rod, sucker rod and other pump components thereby increasing the efficiency of operation of the pumping unit.

Another object of the invention is to provide an oil well pumping unit in which a pair of hydraulically operated piston and cylinder assemblies having one end thereof connected to a stationary support structure and the other end connected to a guided slide assembly associated with a midportion of flexible members having one end anchored and the other end connected to the polish rod whereby expansion movement of the piston and cylinder assemblies is one-half the linear distance moved by the polish rod, thereby providing a compactly arranged oil pumping unit.

Another object of the invention is to provide a well pumping unit in accordance with the preceding objects in which the weight of the pumping unit is substantially less than a conventional oil well pump jack thereby providing a substantial reduction in costs, delivery costs, repair and maintenance costs, and the like, with the stroke and frequency of the stroke being quickly adjustable as compared to several hours of shutdown time required for conventional pump jacks.

Still another object of the invention is to provide a hydraulically operated well pumping unit in accordance with the preceding objects in which all of the components are mounted compactly on a supporting skid or base including a tank or reservoir with substantially all pipes and components being fabricated inside the reservoir thereby reducing the possibility of oil leaks and thereby reducing possible contamination of the environment caused by such oil leaks, with the pump unit being capable of being powered by an electric motor, internal combustion engine, or the like.

A still further object of the invention is to provide an oil well pumping unit which can be constructed in a relatively short period of time thereby eliminating extensive delays in delivering a pumping unit as presently occurs when purchasing a conventional pump jack with the components enabling the device to be completely rebuilt in a very short time, such as approximately two hours as compared to approximately two weeks to rebuild a conventional pump jack thereby substantially reducing the cost of materials, labor costs and shutdown time when rebuilding the pumping unit.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a detailed sectional view of the operating components of the invention illustrating the association of the components with an oil well.

FIG. 3 is a detailed sectional view illustrating the association of the guide structure and slide assembly.

FIG. 4 is a fragmental sectional view illustrating further structural details of the slide assembly and guide structure.

DESCRIPTION OF THE PREFERRED EMBODIMENT

Figure 1:
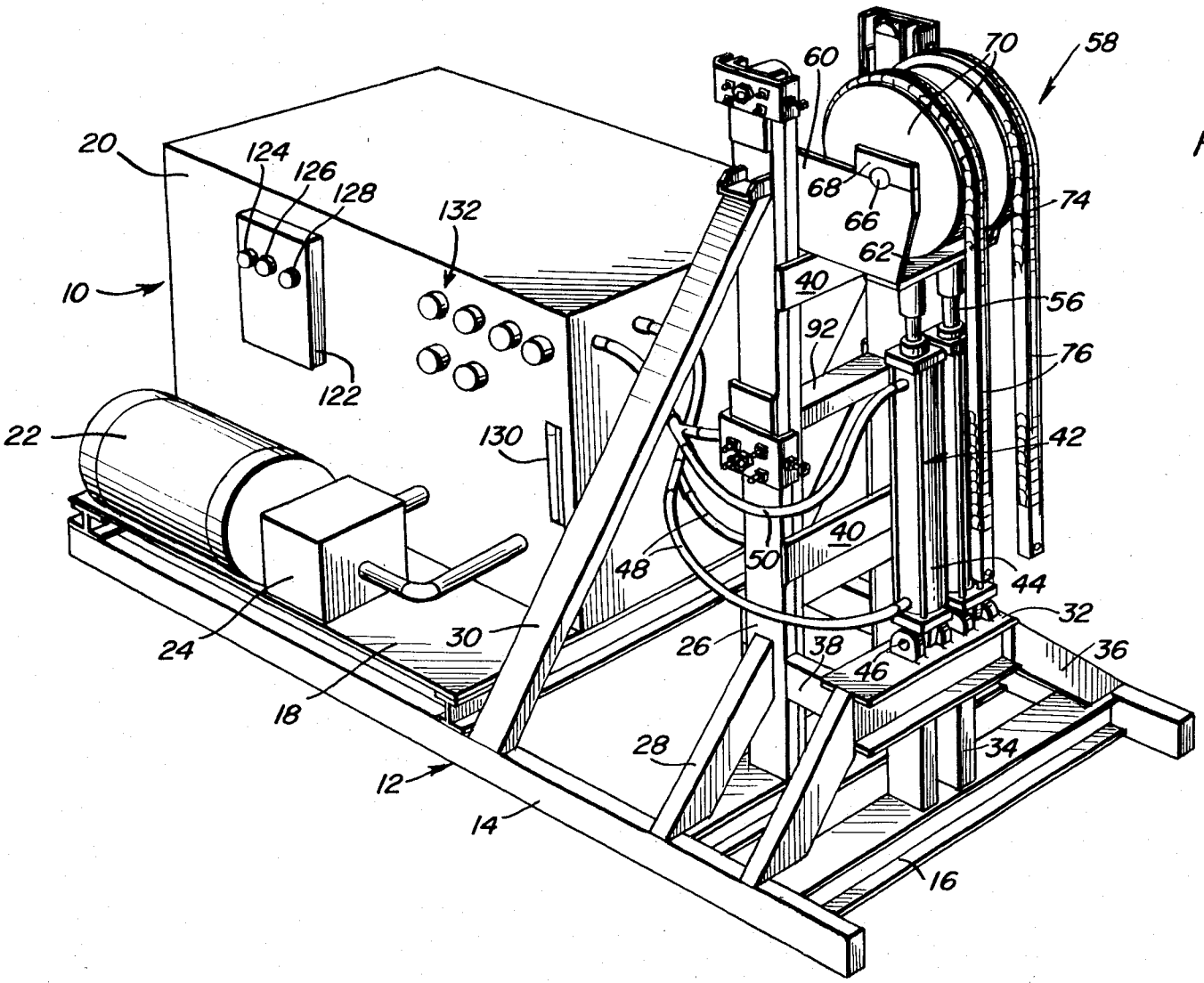
FIG. 1 is a perspective view of the oil well pumping unit of the present invention prior to its association with the oil well.

The oil well pumping unit of the present invention is generally designated by reference numeral 10 and includes a rigid supporting skid or base 12 which includes longitudinally disposed parallel side members 14 and a plurality of transverse members 16 rigidly affixed thereto forming a portable base or skid with one end portion being provided with a platform or deck 18 supporting a tank or reservoir 20 thereon which is oriented to one side of the platform with a motor 22 and pump unit 24 disposed alongside of the reservoir 20 as illustrated. Supported at the opposite end of the skid 12 is a pair of upright, parallel channels 26 having their lower ends rigidly affixed to one of the transverse members 16 and being braced by a lower brace 28 which is outwardly and downwardly inclined and an upper inclined brace 30 thereby providing a rigid supporting structure for maintaining the channels 26 in vertical orientation. Disposed above the outermost transverse beam 16 is a short transverse member 32 supported from the transverse member or beam 16 by vertical support members 34 with the ends of the shorter transverse member 32 being braced by downwardly and outwardly inclined braces 36 and horizontally disposed brackets 38 connecting the shorter transverse member 32 to the vertical channels 26 thereby providing a stationary rigid structure, with the parallalism of the vertical channels 26 also being provided by transversely extending connecting members 40 at vertically spaced points along the channels 26.

Supported from the shorter transverse member 32 is a pair of hydraulically operated piston and cylinder assemblies 42 with each of the cylinders 44 having their lower ends anchored to the transverse member 32 by lugs and pins or bolts as at 46 to enable removal and replacement of the piston and cylinder assemblies when necessary with each of the piston and cylinder assemblies 42 being of identical size and each cylinder 44 including a fluid pressure conduit 48 connected with the lower end of the cylinder and a fluid pressure conduit 50 connected to the upper end of the cylinder 44. The piston rod 56 of each piston and cylinder assembly has a piston on the lower end thereof received in the cylinder with the piston rod 56 extending vertically upwardly from the upper end of the cylinder 44 and being connected to a vertically reciprocal slide assembly 58 which includes a pair of generally vertically disposed side plates 60 interconnected by a bottom plate 62 which is connected to the piston rod 56 by lugs and pins or bolts as at 64 similar to the connection between the cylinders 44 and the transverse member 32 thereby connecting the piston and cylinder assemblies 42 to the slide assembly 58 and enabling replacement when desired.

A horizontally disposed shaft 66 extends between the side plates 60 and is retained in place by bearing caps 68 and the like for rotatably journaling a pair of pulleys or grooves wheels 70 which are directly above the piston and cylinder assemblies 42 as illustrated in FIG. 2 with the pulleys 70 being spaced apart by a spacer sleeve 72, or the like, and provided with a peripheral groove of channel 74 with each pulley 70 having a flexible linked chain 76 entrained thereover with the chain being received in the peripheral channel or groove 74. One end of each of the chains is anchored to a transverse member 40 interconnecting the channels 26 by fastening devices 78, such as bolts or the like, so that the vertically depending end of the chain 76 depending tangentially from the peripheral portion of the pulley 70 adjacent the channels 26 is stationarily anchored so that upon upward movement of the pulley 70, the opposite depending tangential portion of the chain 76 will move a linear distance twice the linear distance moved by the pulleys 70. The depending ends of the chains 76 which are tangential to the peripheral portion of the pulleys 70 remote from the channels 26 are oriented in vertical alignment with a polish rod 80 associated with a stuffing box 82 on the well head 84 having a production line 86 extending therefrom in a conventional and well known manner with a clamp or plate assembly 88 connecting the lower ends of the chains 76 and connecting the lower ends of the chains 76 to the polish rod 80 so that reciprocal movement of the slide assembly 58 will correspondingly reciprocate the polish rod, sucker rods and downhole pump components with the polish rod also moving a linear distance twice that of the slide assembly 58.

The vertically reciprocal slide assembly 58 includes a pair of vertically elongated channels 90 which are interconnected by transverse brace members 92 and a transverse member 94 interconnecting the side plates 60 with the vertical channels 90 extending substantially to the bottom of the channels 26 when the slide assembly 58 is at its lowest point. The side plates 60 extend to the inner edges of the channels 90 so that the channels 90, which face outwardly, are received between the flanges on the channels 26. Each channel 26 is provided with a pair of guide roller assemblies designated generally by numeral 96 with one guide roller assembly being at the upper end of the channel 26 and the other guide roller assembly being generally at the center thereof. Each guide roller assembly includes a guide roller 98 supported on an axle 100 extending through the channel 26 and being supported by a channel-shaped plate 102 attached to the channels 26 by bolts 104. Adjustment bolts 106 extend through the flanges on the channel-shaped bracket plate 102 and have inner ends abutting the channel 26 on that by loosening the nuts on the bolts 104 which are received in slot-like openings, rotation of the bolts 106 may be utilized to properly adjust and position the guide roller 98 to orient and guide the channels 90 thereby guiding the slide assembly so that it moves vertically as the piston and cylinder assemblies 42 are extended and retracted.

Figure 5:
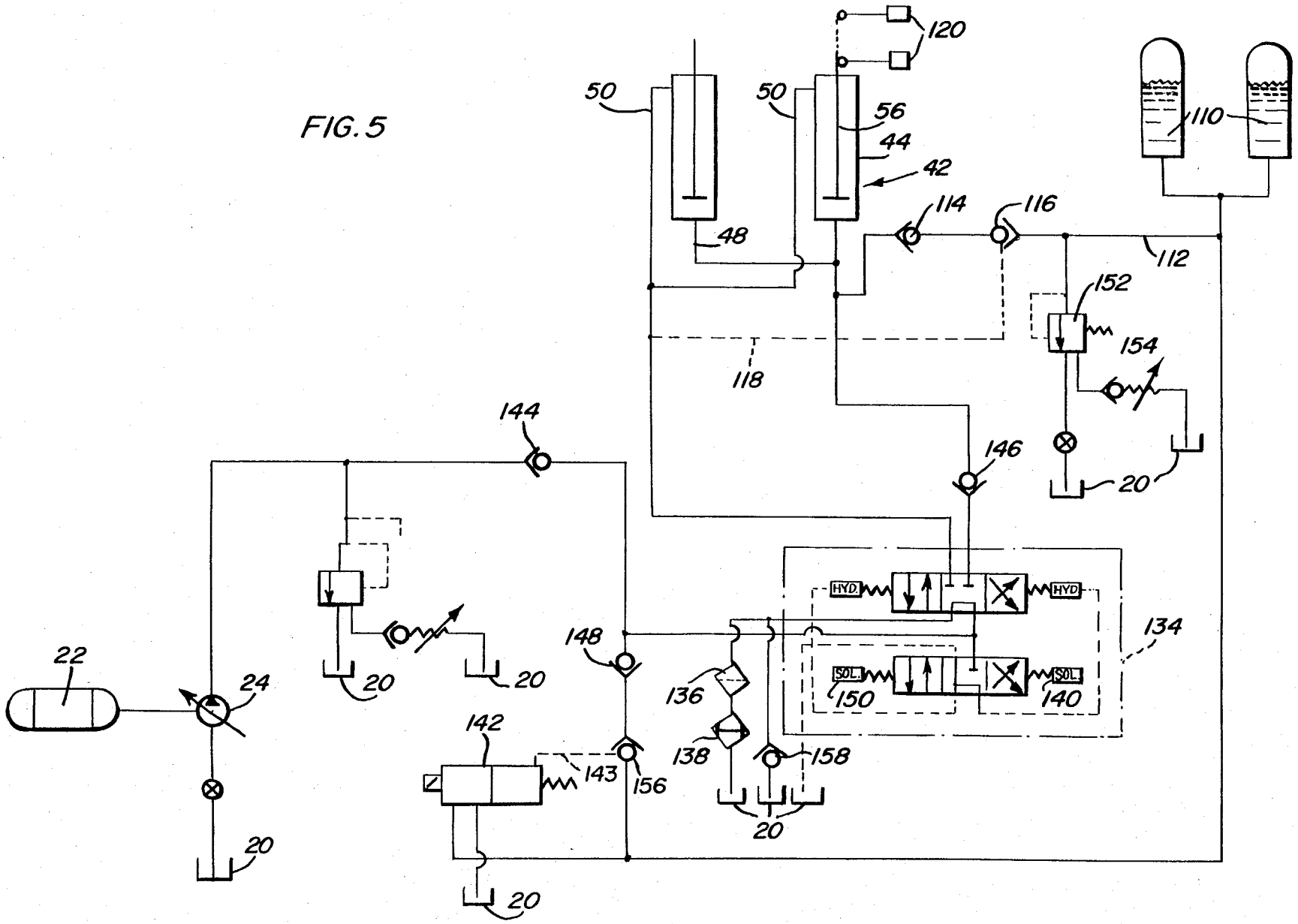
FIG. 5 is a diagrammatic view of the hydraulic system of the pumping unit.

As illustrated, the conduits 48 connected with the bottom of the cylinders 44 are in communication with a pair of accumulators 110 diagrammatically illustrated in FIG. 5 by a conduit 112 which includes a check valve 114 for flow toward the accumulators and a pilot operated check valve 116 controlled by a pilot conduit 118 communicated with the conduit 50 extending to the upper ends of the piston and cylinder assemblies 42. A pair of limit switches 120 are provided for actuation by movement of the piston rod 56 to adjust the upper and lower limits of movement thereof. The reservoir 20 is provided with a control box 122 mounted thereon or the control box may be mounted in any other manner for easy access with three push button switches 124, 126 and 128 being provided thereon. Also, the reservoir is provided with a sight gauge 130 and pressure gauges 132 thereon and a float switch may be provided in the reservoir, if desired. Switch 124 may be an on and off selector switch, while switch 126 is an automatic or manual selector switch, whereas switch 128 is an up or down selector switch. In operation, the switch 126 is first set to the manual position and the selector switch 124 is then actuated to the on position which will actuate the motor pump unit so that fluid will be pumped through valve assembly 134 through a filter 136 and a heat exchanger 138 back to the reservoir 20 for recirculation of the fluid. The selector switch 128 is to be used only when switch 126 is in the manual position since this sequence is used for set up and test only. Now the selector switch 126 is moved to the automatic position which will start the machine in a reciprocating cycle. On the upstroke, solenoid 140 of valve assembly 134 and solenoid valve 142 are energized directing the flow of oil from the pump unit 24 through check valve 144, valve assembly 134 and check valve 146 to extend the piston and cylinder assemblies 42 to the desired stroke. During the upstroke, check valve 148 is closed and check valve 114 opens to valve 116 which is closed thereby blocking oil from entering the accumulators 110 during the upstroke. Thus, during upstroke, oil flows from pump unit 24 through check valve 144 and oil flows from accumulators 110 through opened valve 156 with all oil flowing through valve 134 and through check valve 146 and then through conduits 48 into the lower ends of cylinders 44 thereby lifting the polish rod 80 and associated components and the column of production fluid. As this occurs, oil returns to reservoir 20 from the top of the cylinders 44 through conduits 50 and valve 134.

When the piston and cylinder assemblies 42 are extended to the desired stroke, it will contact upper limit switch 120 deenergizing the solenoid valve 142 which closes with pilot pressure being bled to reservoir 20. Also, the solenoid 140 of the valve assembly 134 is deenergized and solenoid 150 of valve assembly 134 is energized so that when the valve assembly 134 shifts, pressure from the pump unit 24 will start to increase in the valve assembly 134 and conduit 50 to open the pilot operated valve 116 which also permits check valve 114 to open and valve 146 closes so that oil from the bottom end of the cylinders is forced through the conduits 48 into the accumulators 110 and captured as reuseable energy. As the polish rod 80 reenters the well hole, the pressure in the accumulators is controlled by valves 152 and 154 which are relief valves to prevent the polish rod from falling too fast and causing rod damage to the well and its components. As the piston rod 56 reach the bottom of the stroke, they will contact the lower limit switch 120 to deenergize the solenoid 150 and energize solenoid 140 of the valve assembly 134 and solenoid 142. The upper limit switch 120 is connected to the solenoid 140 through an adjustable timer to delay the signal to the solenoid 140 and solenoid valve 142, thereby allowing no stretch to the polish rod. When solenoid valve 142 and solenoid 140 of valve assembly 134 are energized, oil will flow through pilot conduit 143 from valve 142 to pilot operated check valve 156 thereby opening valve 156 for permitting the stored energy in the accumulators 110 to be release to valve 134 and used for upstroking the pistons, thus resulting in approximately 30% to 40% power savings. It is pointed out that when valve 134 shifts at the end of the upstroke, there will be an increase in pressure in conduits 50 which will open the pilot operated valve 116 so that all of the oil which is discharged from the bottom ends of the cylinders 44 through conduits 48 will flow into the accumulators 110;

The length of the stroke is adjusted by adjusting lower limit switch 120 vertically on a slide rail with this adjustment requiring a very short amount of time, such as a minute or two. The number of strokes per minute can be adjusted by a pneumatic timer or the like which also requires a very short time. During the cycling of the maching, all oil is returned to the reservoir through filter 136 and heat exchanger 138 for continuous filtering the cooling. Check valve 158 may be a pressure relief valve of predetermined pressure used to protect the heat exchanger and filter from excessive pressure surges.

The frame or skid may be provided with a push-off device for the purpose of pushing itself away from the well when maintenance is required on the well and pull itself back into position when required, thus eliminating the need for heavy equipment as necessary in a conventional unit.

With this unit, all oil on the bottomside of the pistons is displaced into the accumulators on the downstroke thereby storing the energy produced by gravity movement of the components of the pump, sucker rod, polish rod, and the like, with this stored energy being reuseable when the pistons reach the bottom of their stroke by introducing this pressure into the lower ends of the cylinders, thereby assisting in lifting the components of the pump and introducing considerable savings in energy and increasing the efficiency of operation. The weight of this unit is approximately one-sixth of a conventional pump jack of comparable capacity and the length of stroke and frequency of stroke can be quickly and easily adjusted without excessive shutdown, that is, in several minutes as compared to four to six hours. The shipping cost of this unit is about one-sixth of a conventional unit and repair and maintenance is considerably reduced and when it is necessary to completely rebuild the unit, the cost and labor as well as shutdown time is materially reduced in this unit as compared to a conventional pump jack.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A well pumping unit comprising a supporting structure including a vertical guide, a slide assembly mounted on the vertical guide, said slide assembly including pulley means thereon, a flexible member entrained over the pulley means with one end anchored stationarily to the supporting structure and the other end connected to the upper end of a polish rod for reciprocating the polish rod vertically, vertically disposed hydraulically operated piston and cylinder means interconnecting the slide assembly and the supporting structure to vertically reciprocate the slide assembly thereby reciprocating the polish rod a distance twice the vertical movement of the slide assembly, said hydraulically operated piston and cylinder means being connected to a hydraulic system having means communicating the piston and cylinder means with accumulator means for storing energy during the downstroke of the slide assembly and polish rod, said hydraulic system including valve means admitting pressurized fluid from the bottom of the piston and cylinder means into the accumulator means during the downstroke and automatically releasing the pressurized fluid from the accumulator means back into the bottom of the piston and cylinder means during the upstroke thereby assisting in the upstroke of the piston and cylinder means and slide assembly, said vertical guide including a pair of substantially vertical channels, a pair of vertically spaced guide rollers in each channel, said slide assembly including a pair of vertically disposed channels receiving the guide rollers for guiding vertical movement of the slide assembly in relation to the vertical guide.

2. The structure as defined in claim 1 together with means mounting the guide rollers on the vertical guide channels enabling lateral adjustment thereof to orient the guide rollers in vertical orientation, thereby orienting the slide assembly for vertical movement parallel to the axis of reciprocatory movement of the polish rod.

3. The structure as defined in claim 2 wherein the pulley means on said slide assembly includes a pair of pulleys each having a peripheral groove, said flexible member including a pair of chains entrained over the pulleys with one end anchored to the vertical guide and the other end connected to the polish rod.

4. The structure as defined in claim 3 wherein said piston and cylinder means includes a pair of vertical hydraulically operated piston and cylinder assemblies oriented directly below the center of the pulleys.

5. The structure as defined in claim 4 wherein said support structure includes a skid having a reservoir, a pump and motor unit associated therewith and rigidifying brace structures for the vertical guide and supporting the lower ends of the hydraulically operated piston and cylinder assemblies.

6. A well pumping unit comprising a supporting structure including a vertical guide, a slide assembly vertically movably mounted on the vertical guide and including vertically spaced guiding means to stabilize the slide assembly, said slide assembly including pulley means rotatably supported thereon, a flexible member entrained over the pulley means with one end anchored stationarily to the supporting structure below the pulley means and the other end connected to the upper end of a polish rod oriented below the pulley means for reciprocating the polish rod vertically when the slide assembly is vertically reciprocated, hydraulically operated piston and cylinder means interconnecting the slide assembly and the supporting structure to vertically reciprocate the slide assembly thereby reciprocating the polish rod a distance twice the vertical movement of the slide assembly, said hydraulically operated piston and cylinder means being connected to a hydraulic system having means communicating the piston and cylinder means with accumulator means for storing energy during the downstroke of the slide assembly and polish rod, said hydraulic system including valve means admitting fluid from the bottom of the piston and cylinder means into the accumulator means during the downstroke and automatically releasing the stored energy from the accumulator means back into the bottom of the piston and cylinder means during the upstroke thereby assisting in the upstroke of the piston and cylinder means and slide assembly, said piston and cylinder means including a generally vertically disposed piston and cylinder assembly having the lower end thereof communicated with the accumulator means through a first pilot operated valve open during the downstroke of the piston and cylinder assembly and communicated with the lower end of the piston and cylinder assembly through a second pilot operated valve controlled by a solenoid operated valve during the upstroke thereof.

* * * * *